United States Patent [19]

van Leeuwen et al.

[11] Patent Number: 4,473,617

[45] Date of Patent: Sep. 25, 1984

[54] SYNTHETICAL TECHNICAL MULTIFILAMENT YARN AND A PROCESS FOR THE MANUFACTURE THEREOF

[75] Inventors: Johannes H. van Leeuwen, de Steeg; Karl A. Weigand, Eefde, both of Netherlands

[73] Assignee: Akzo nv, Arnhem, Netherlands

[21] Appl. No.: 339,706

[22] Filed: Jan. 15, 1982

[30] Foreign Application Priority Data

Jan. 15, 1981 [NL] Netherlands ..... 8100161

[51] Int. Cl.[3] ..... D02G 3/00; D02G 3/02; B29F 3/10

[52] U.S. Cl. ..... 428/373; 428/379; 264/171; 57/244

[58] Field of Search ..... 428/372, 373, 379, 375, 428/374; 264/171; 57/244

[56] References Cited

U.S. PATENT DOCUMENTS 3,551,279 12/1970 Ando ..... 428/373

3,803,453 4/1974 Hull ..... 428/372

4,085,182 4/1978 Kato .

4,207,376 6/1980 Dagayasu et al. ..... 428/373

*Primary Examiner*—George F. Lesmes

*Assistant Examiner*—Beverly K. Johnson

*Attorney, Agent, or Firm*—Stevens, Davis, Miller & Mosher

[57] ABSTRACT

The invention relates to a synthetic technical multifilament bicomponent yarn, which is particularly meant for use in safety belts, ropes and nets.

The bicomponent yarn is preferably of the sheath-core type of which only the core contains a black pigment composed of carbon black particles and/or a reddish pigment composed of iron oxide particles and/or a whitish pigment composed of titanium dioxide particles of the rutil type, which pigments are insoluble in the polymeric material. The tenacity of the yarn may be about 70–85 cN/tex and the elongation at rupture of 7 to 15%.

23 Claims, 5 Drawing Figures fig.1
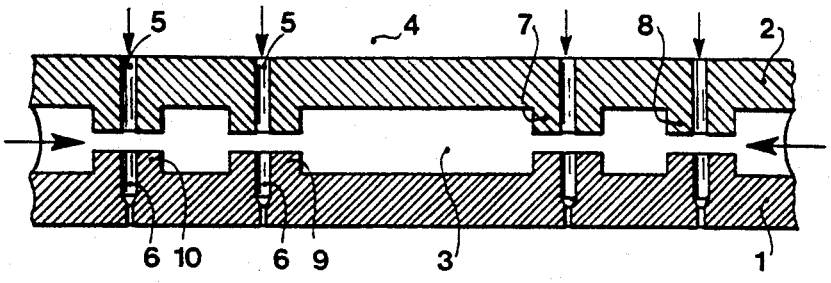
fig.2
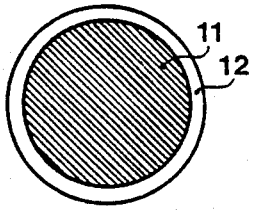
fig.3
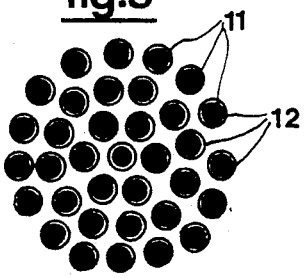
fig.4
fig.5
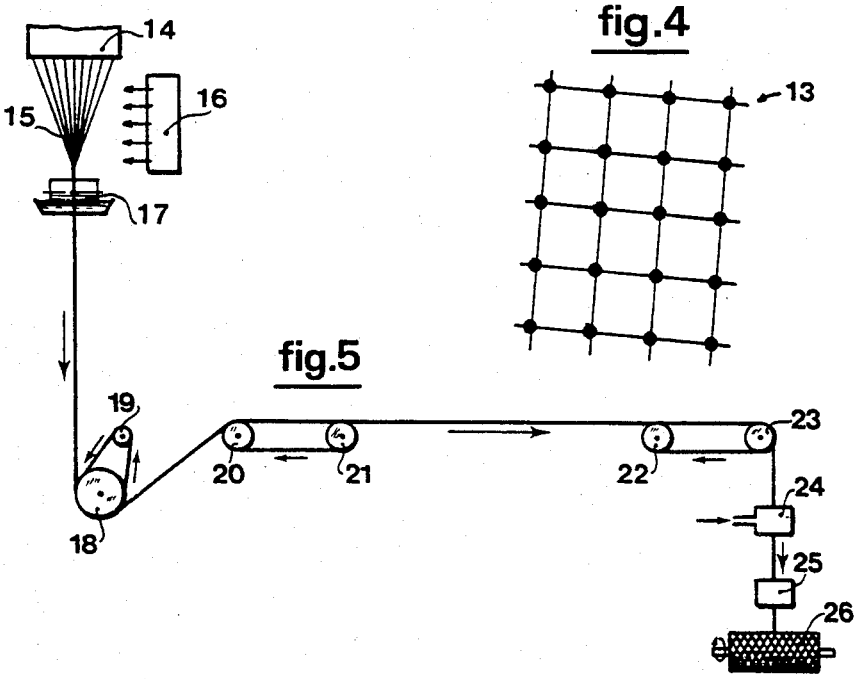

SYNTHETICAL TECHNICAL MULTIFILAMENT YARN AND A PROCESS FOR THE MANUFACTURE THEREOF

BACKGROUND OF THE INVENTION

1. Field of the Invention

The invention relates to a synthetic technical yarn formed from a number of endless bicomponent filaments of the sheath-core type of which both the sheath and the core are composed of a melt-spinnable polymer. The invention also comprises a process for the manufacture of such a yarn.

2. Description of the Prior Art

A yarn of the type indicated above is known from Netherlands Patent Application No. 6 512 920. In this known yarn, the core of the filaments preferably consists of polyethylene terephthalate and the sheath of nylon 6. The yarns described in said publication were to be used for the manufacture of a reinforcing fabric for elastomeric objects, more particularly pneumatic tires for vehicles. These known yarns are virtually colourless.

For various uses, such as nets, ropes and seat-belts for vehicles there are marketed at present black technical synthetic multifilament yarns that consist essentially of polyamide-6 or polyamide-66 or of polyester. In the melt spinning process used by fiber manufacturers, such black yarns may be obtained by injecting into the melt a black pigment, more particularly carbon black particles. Alternatively, the product may be obtained by feeding polymer granules blackened with a black pigment to an extruder.

Although reasonable results may be obtained with these known black polyamide or polyester yarns, they do display several disadvantages. One of these disadvantages is the fact that during the manufacture, treatment and processing of the yarn, such as drawing, winding, twisting and the like, the black pigment present on the surface of the yarn gives rise to great wear of various more or less costly machine parts, such as rollers, guiding elements, heating elements, including hot plates or hot pins, with which the yarn comes into contact. This drawback has in the last few years become of increased importance in view of the fact that manufacturers of synthetic yarns will replace the conventional process for manufacturing technical or industrial yarns with a more integrated spin-drawing process. In the conventional process referred to the yarn is spun and wound in a first process step and drawn and wound in a second, separate process step. In said spin-drawing process, however, the above-mentioned first and second process steps are combined into a single, continuous process in which the spun yarn is drawn and wound. In order to obtain a nylon or polyester technical yarn of sufficient strength, the practice is often to draw such a yarn at a draw ratio in the range of 5 to 6. Since after the change over from the conventional process to the integrated process the same output per spinning machine will be required, the drawing operation in the spin-drawing process wil take place at considerably higher speeds than in the conventional process. The higher yarn speeds and higher yarn tension will lead to a very significant increase in the wear of machine parts and said spin-drawing of black yarns will very readily cause deep incisions in the machine parts with which the yarns come into contact. The problem of these incisions is so serious that in actual practice it makes it impossible for spun-dyed, black yarns to be made by the spin-drawing process. The incision problems caused by black pigment likewise occur in the case of a reddish pigment made up of iron oxide particles and a whitish pigment made up of titanium dioxide particles of the rutil type. It should be added that titanium dioxide of the rutil type is described on page 246 of the book "Pigments, Herstellung, Eigenschaften, Anwendung", by H. Kittel, 1960, Wissenschaftliche Verlagsgesellschaft MBH, Stuttgart, BRD.

SUMMARY OF THE INVENTION

The invention has for its object the elimination of the above-mentioned drawbacks. The synthetic technical yarn consisting of a number of filaments which are each composed of one or more melt-spinnable polymeric materials is in the first place characterized according to the invention in that substantially only inwardly from their peripheral zone the filaments contain a black pigment composed of carbon black particles and/or a reddish pigment composed of iron oxide particles and/or a white pigment composed of titanium dioxide particles of the rutil type, which pigments are insoluble in the polymeric material, and the tenacity of the yarn is at least 50 cN/tex and not higher than 150 cN/tex. The synthetic technical yarn formed from a number of endless bicomponent filaments of the sheath-core type, of which both the sheath and the core are of a melt-spinnable polymer, are characterized according to the invention in that substantially only the core of the filaments contains a black pigment composed of carbon black particles and/or a reddish pigment composed of iron oxide particles and/or a white pigment composed of titanium dioxide particles of the rutil type, which pigments are insoluble in said core, and the tenacity of the yarn is at least 50 cN/tex and not higher than 150 cN/tex, but preferably 70 to 85 cN/tex. According to the invention the core of practically all of the filaments, for instance 50–150 filaments of the yarn, contains said pigments in an amount of 0.2 to 2 percent by weight and not more than 5% by weight, and preferably about 0.6% by weight, calculated on the weight of the core. The yarn according to the invention is advatageously characterized by an elongation at rupture in the range of 7 to 15%, preferably 11 to 15%. The yarn according to the invention preferably has a single filament titer in the range of from decitex 3 to 20. Since the pigments of black carbon black particles and/or reddish iron oxide particles and/or titanium dioxide particles of the rutil type are entirely or substantially present only in the core polymer of the bicomponent filaments of the yarn according to the invention, the sheath or said peripheral zone of the filaments and the surface of the yarn consequently being free of said pigments, the yarn according to the invention can be made by the spin-drawing process. Thus, an important economic advantage is obtained over the conventional yarns, wherein the pigment is distributed throughout the cross-section of the filaments and is also present on the surface thereof. The yarn according to the invention does not display any great abrasive or wearing action on various machine parts.

Despite the presence of said black and/or reddish and/or whitish pigment the yarn according to the invention is, as a result of its bicomponent structure, characterized in that for a yarn having 75 to 110 filaments and a linear density of about dtex 1000 the incision factor is smaller than 250 μm $m^2$/hour and generally smaller than 150 μm $m^2$/hour.

A favourable embodiment of the yarn of the present invention is characterized in that in the filaments the percent sheath by volume is 50 to 15%, preferably 25%, and the percent core by volume is 50 to 85%, preferably 75%. An effective embodiment of the yarn is characterized according to the invention, in that the sheath of the bicomponent filaments is transparent and composed of polyamide, more particularly nylon-6 or nylon-66, or of polyester, polypropylene, copolyester, copolyamide or copolyolefins.

Favourable results are obtained if for the core of the bicomponent filaments a polymer is chosen which is commonly applied for technical yarns, such as polyester, more particularly polyethylene terephthalate, polyamide, more particularly nylon-6 or nylon 66, or copolyester or copolyamide. The polyesters and polyamides mentioned here are to be understood as including both homopolymers and copolymers.

Also cords, cables, ropes, fishing nets or seat belts made from the yarns according to the invention display quite a few advantages, in addition to the fact that no significant wear or incision of machine parts is expected during manufacture and further processing. Furthermore, ropes obtained by braiding, laying or twisting yarns according to the invention possess improved strength efficiency.

Particularly when a fishing net has been made from bicomponent yarns having a nylon sheath and a polyester core, the net obtained will show the favourable knot strength of the nylon sheath while retaining the tenacity and the thermal properties of polyester.

The black bicomponent yarns according to the invention having a nylon-6 sheath and a polyethylene terephthalate core are also particularly suitable to be used for the manufacture of black fishing nets. Such nets made from the yarn according to the invention do not cause excessive wear during their manufacture or their use, often under a high load, on fishing boats. Further, when used in nets, the bicomponent yarns having a nylon sheath and a polyester core according to the invention have the advantage over the known black non-bicomponent and wholly nylon yarns that they have a smaller diameter and, hence, a smaller volume at approximately the same breaking strength and tenacity. For yarns having the same total linear density, the black or reddish or brownish bicomponent yarn according to the invention has a 7% smaller diameter and a 14% smaller volume than the wholly polyamide yarn. Owing to the smaller diameter and the smaller volume of the yarns according to the invention, the nets made of these yarns have a lower flow resistance in water, which leads to a considerable energy savings in fishery, especially when use is made of trawl nets. Moreover, the nets according to the invention have a higher speed of fall into the water and they take up less storage room than nets of wholly polyamide yarns. Another advantage is that the knots in the nets are smaller and, hence, permit using less yarn.

The invention is especially directed to a technical yarn, i.e. a yarn not intended for textile uses, but for technical or industrial uses, such as nets, ropes, seat belts and like products. The yarn according to the invention is essentially of the type having a total linear density of decitex 300 to 5000 and 30 to 600 filaments, a tenacity of 50 to 150 cN/tex and an elongation at rupture in the range of 7 to 25%. Of the yarn according to the invention having a sheath of nylon 6 and a core of polyethylene terephthalate, the knot strength, which is of importance for its use in nets, is in the range of 330 to 400 mN/tex. The knot strength of the bicomponent yarn according to the invention is consequently at the same level as that of known wholly polyamide yarns.

For certain uses, the yarn according to the invention has on its surface an oil content of 0.05 to 1% by weight.

The invention also comprises a process for the manufacture of a technical yarn in which molten synthetic polymer streams are so extruded through a large number of spinning orifices that bicomponent filaments of the sheath-core type are formed, which process is characterized in that substantially only to the core of the filaments there is added a black pigment made up of carbon black particles and/or a reddish pigment made up of iron oxide particles and/or a white pigment made up of titanium dioxide particles of the rutil type, which pigments are insoluble in the core of the filaments, and the yarn is drawn at such a draw ratio in the range of 3 to 8, more particularly 5 to 6, that the tenacity of the yarn is at least 50 cN/tex and at most 150 cN/tex, the core of the filaments containing 0.2 to 2%, preferably about 0.6% by weight of pigment, calculated on the weight of the core. According to a preferred embodiment of the method of the invention, the bicomponent yarn is spun and drawn in a continuous operation, i.e. spun-drawn and subsequently wound.

It should be added that in Japanese Patent Application No. 7150/66 (Publication No. 3001/68) there is described a bicomponent multifilament yarn of the sheath-core type of which both the sheath and the core are of different polyesters having intrinsic viscosities in the range of 0.56 to 0.7.

Example 1 of the Japanese publication describes a sheath-core yarn of which the core contains some unspecified percentage of carbon black particles. From the values of the intrinsic viscosities alone, it is apparent that said Japanese publication relates to a yarn intended for textile uses, in which case the problem of the abrasive and incisive action will not be so serious because of the lower forces and tensions, lower draw ratio and quite different practical uses.

It should also be added that for the purpose of rendering multifilament carpet yarn antistatic one or more antistatic filaments are incorporated into it. To that end, various types of bicomponent multifilaments may be used. Notably, U.S. patent specification No. 3,803,453 describes antistatic bicomponent filaments of the sheath-core type comprising a sheath of some synthetic polymer and a black core which is rendered electrically conductive by the presence of at least 15–20% by weight of carbon. Due to this large amount of carbon pigment, the physical properties, such as tenacity and elongation, of these antistatic filaments are so unfavourable and differ so much from those of normal filaments that they are only suitable for performing their antistatic function. Further, the sheath of the antistatic filaments contains titanium dioxide pigment in order to hide the black core colour as much as possible, which is undesirable in carpet yarns. In these known antistatic filaments the black core is less than 50% by volume. As mentioned before, the technical bicomponent yarn according to the invention has in its core only a small percentage of black and/or reddish and/or white pigment, as a result of which its physical properties are good and at a level which is usual for technical yarns. Moreover, the yarn according to the invention has a transparent sheath, so that the black core is properly visible and its black appearance is satisfactorily ensured even if use is made of a small amount of carbon pigment.

BRIEF DESCRIPTION OF THE DRAWINGS

The invention will be illustrated with reference to the accompanying schematic drawing.

FIG. 1 shows the disposition of two spinnerets.

FIG. 2 is a cross-sectional view of one filament on a greatly enlarged scale.

FIG. 3 shows a number of filaments of a yarn according to the invention in cross-section.

FIG. 4 depicts a portion of a net made from cords according to the invention.

FIG. 5 is a schematic representation of a spin-drawing process.

DETAILED DESCRIPTION OF THE PREFERRED EMBODIMENTS

In FIG. 1 the numerals 1 and 2 refer to parts of two spinnerets. The two plates are spaced from each other and arranged in parallel in a melt spinning assembly. Between the plates 1 and 2 and above the plate 2 are two chambers 3 and 4, respectively, which are connected to two feed lines for two spinning liquids (not shown). Through the spinneret 2 runs channels 5 which end in the chamber 3 at a point opposite channels 6 provided in the spinneret 1.

The channels 6 converge at their outlet ends at the lower side of the plate 1. Spinning liquid flowing through the channel 6 is cooled in the ambient air below the spinneret 1 to form filaments which are subsequently drawn off and wound in a known manner. Into the chamber 3 there is forced the sheath polymer, for instance a nylon-6 melt, and into the chamber 4 a melt of the core polymer, for instance of polyethylene terephthalate, containing 0.6% by weight of carbon particles.

In this process the polyethylene terephthalate is extruded through the channels 5 in the direction of the channels 6, to which also the nylon-6 melt is displaced. Through the channel 6 there will consequently be a downward flow of a skin or sheath of nylon 6 containing a core of polyethylene terephthalate. Thus, the filaments formed therefrom have a skin of nylon-6 and a black core of polyethylene terephthalate. At the outlet openings of the channels 5 in the spinneret plate 2 there are provided protrusions 7 and 8 and at the inlet openings of the channels 6 in the spinneret plate 1 there are protrusions 9 and 10. These protrusions may be in the form of circular rims or of cylinders concentrical with the channels. These protrusions 7 through 10 serve to influence the flow pattern in the constrictions formed by them.

FIG. 2 shows on an enlarged scale a cross-section through a filament spun from one of the spinning orifices 6, the flow of skin liquid to the channel 6 having taken place truly symmetrical and at a constant velocity. The resulting core 11 is round and truly concentrical with the skin 12.

FIG. 3 is a cross-sectional view of a great number of filaments of the technical yarn according to the invention.

FIG. 4 shows a detail of a fishing net 13 made from cords composed of the bicomponent yarns according to the invention.

FIG. 5 is a very schematic representation of a process for spindrawing the bicomponent yarn according to the invention. After having left the melt spinning assembly 14 containing spinnerets of the type shown in FIG. 1, a bundle 15 of bicomponent filaments is cooled by means of a blowbox 16, after which the bundle passes over a kiss roll 17 by which a lubricant is applied to it. Subsequently, the bundle is passed a few times around a driven feed roll 18 with idler roll 19, which have a constant peripheral velocity $V_1$ of the order of, for example, 400 m/min. Next, the yarn bundle 15 is passed over a pair of driven draw rolls 20 and 21, which have a constant peripheral speed $V_2$ and a temperature of, for example, 200° to 220° C. The velocity $V_2$ is considerably higher than the velocity $V_1$ and the ratio V2:V1 is the draw ratio of the yarn bundle. For the bicomponent filament yarns according to the invention having a core of polyethylene terephthalate or nylon 6, the draw ratio $V_2$:$V_1$ will generally be in the range of 5 to 6. At a draw ratio of 6 the peripheral velocity $V_2$ may for instance be 2400 m/min. Subsequently, the yarn is passed over a pair of driven rolls 22, 23, which have a peripheral velocity $V_3$, which is lower than $V_2$ and may be, for instance, 2375 m/min., the temperatures of the rolls 22, 23 being about 140°–160° C. Further, some coherency is imparted to the yarn in a tangling device 24 with the aid of air under pressure.

Finally, the tangled yarn is provided with a small amount of oil at a point 25 before being wound into a package 26.

For further elucidation of the invention and for testing the yarn and the cord properties, measurements were conducted on a number of yarns and cords. All 7 yarns were black and the various yarns are denoted hereinafter by the test numbers 1, 2, 3, 4, 5, 6 and 7. Table I gives the nature of the various yarns 1 through 7. Table II mentions the most important yarn properties and Table III gives the properties of the cords made from these yarns.

TABLE I

| Test No. | Yarn type | Process | Titre (dtex) desired | After oil wt. % | Yarn composition Core | Sheath |
|---|---|---|---|---|---|---|
| 1 | Bico | conv. | 940 f76 | 0 | 75% PETP; 0.6 wt. % Ketjenprint 25 $\eta$ = 1.89 | 25% PA.6 $\eta$ = 2.75 |
| 2 | Bico | spindr. | 940 f76 | 0 0 | 75% PETP; 0.6 wt. % Ketjenprint 25 $\eta$ = 1.89 | 25% PA. $\eta$ = 2.75 |
| 3 | Bico | spindr. | 940 f76 | 0.2 | 75% PETP; 0.6 wt. % Ketjenprint 25 $\eta$ = 1.89 | 25% PA. $\eta$ = 2.75 |
| 4 | Mono | conv. | 1100 f105 | 0 | PETP; 0.6 wt. % Ketjenprint 25 | — |
| 5 | Mono | conv. | 1100 | 0.2 | PETP; 0.6 wt. % | — |

TABLE I-continued

| Test No. | Yarn type | Process | Titre (dtex) desired | After oil wt. % | Yarn composition Core | Sheath |
|---|---|---|---|---|---|---|
| 6 | Bico | spindr. | f105 940 | 0 | Ketjenprint 25 75% PETP; 0.6 wt. % | 25% PETP |
| 7 | Bico | spindr. | f76 940 | 0.2 | Ketjenprint 25 75% PETP; 0.6 wt. % | 25% PETP |
| | | | f76 | | Ketjenprint 25 $\eta$ = 1.89 | $\eta$ = 1.85 |

TABLE II

| property | sample composition 1 | 2 | 3 | 4 | 5 | 6 | 7 |
|---|---|---|---|---|---|---|---|
| | | PETP black/ PA white | | PETP | black | PETP black/ PEPT white | |
| titre dtex (actual) | 948 | 947 | 948 | 1108 | 1108 | 952 | 953 |
| tenacity cN/tex | 77.6 | 77.3 | 71.1 | 70.0 | 70.1 | 69.0 | 70.3 |
| elongation at rupture % | 11.2 | 14.2 | 13.0 | 10.6 | 10.3 | 14.1 | 14.7 |
| loop breaking strength cN/tex | abt. 50 | abt. 50 | abt. 50 | abt. 50 | abt. 50 | abt. 50 | abt. 50 |
| hot-air shrinkage 4 min - 160° C. | 6.4 | ta 7.0 | 7.1 | 5.4 | 5.4 | 5.7 | 5.5 |
| incision factor $\mu m^2$/hour | 0 | 113 | 75 | 1350 | 900 | none | none |

TABLE III

| property | sample composition 1 | 2 | — ETN25 3 | 4 | — ETN25 5 | 6 | — ETN25 7 |
|---|---|---|---|---|---|---|---|
| | | PETP black/ PA white | | PETP black | | PETP black/ PEPT white | |
| titre dtex | 3031 | 3009 | 3014 | 3604 | 3598 | 3012 | 3050 |
| tenacity cN/tex | 69.0 | 65.8 | 66.2 | 60.5 | 61.2 | 62.6 | 62.8 |
| elong. at rupture % | 15.8 | 18.7 | 18.8 | 16.6 | 16.7 | 17.6 | 19.2 |
| knot strength (dry) cN/tex | 33.0 | 31.2 | 39.0 | 30.9 | 32.0 | 31.7 | 38.9 |
| boiling shrinkage | | | | | | | |
| dry % | 7.4 | 7.3 | 7.2 | 5.5 | 5.5 | 5.3 | 4.3 |
| wet % | 7.4 | 7.3 | 7.2 | 5.3 | 5.4 | 5.2 | 4.3 |

The yarns 1, 2, 3, 6 and 7 are bicomponent multifilament yarns according to the invention. The filaments of the yarns 1, 2, 3, 6 and 7 have a core of polyethylene terephthalate (PETP), which forms 75% by volume of each filament.

Of the PETP used the relative viscosity was $\eta_{rel}$=1.89 before spinning. Further, to the PETP in the core of all the yarns 1, 2, 3, 6 and 7 there had been added a black pigment in the form of carbon black particles in an amount of 0.6% by weight, calculated on the PETP of the core, which additive is marketed under the trade name Ketjen Print type 25 and conforms to the following specifications:

| | |
|---|---|
| Nigrometer value | 88 |
| Surface | |
| Determined by $J_2$ method ASTM-D1510-79 mg/g | 86 |
| $N_2$ adsorption (ASTM-D3037-78) $m^2$/g | 82 |
| Mean particles diameter ångstrom (electronic microscope) | 310 |
| Tinting strength (ASTM-D3265-79) % | 220 |
| DBP*[1] absorption powder (fluffy) ml/100 g (ASTM-D2414-79) | 76 |
| Slurry pH (ASTM-D1512-75) | 8.0 |
| Volatile constituents % | 1.5 |
| Sieve residue (+325 mesh) (ASTM-D1514-79) max. % | 0.03 |
| Moisture content (ASTM-D1509-79) max. % | 1.5 |
| Ash content (ASTM-D1506-79) max. % | 0.5 |

-continued

| | |
|---|---|
| Specific weight in compressed form g/l (powder-fluffy) | 150 |

*[1]DBP = dibutylphthalate

Unlike the yarns 2, 3, 6 and 7, the yarn 1 was not made by the spindrawing process, but in a conventional manner, i.e. spinning and drawing were effected discontinuously in two separate processes. As far as the yarns 1, 2 and 3 are concerned, 25% by volume of each filament was formed by a skin of nylon-6 (PA-6), which had a relative viscosity of $\eta_{rel}$=2.75 before spinning.

In the bicomponent yarns 6 and 7 the proportion by volume of the skin of each filament was 25%, the skin being spun from PETP of the 441 type which had a relative viscosity of $\eta_{rel}$=1.85 before spinning. PETP of the 441 type differs from the PETP used in the core mainly in that it contains no black pigment. The above-mentioned relative viscosity values were determined at 25° C. in a 1% metracresol solution.

The yarns 4 and 5 are not yarns according to the invention, but monocomponent yarns. However, these yarns also are coloured black as a result of the addition of about 0.6% by weight of black pigment consisting of carbon black particles, which are uniformly distributed throughout the cross-section of each filament, so that the pigment is also present on the outer surface of the filaments.

In the monocomponent yarns 4 and 5 the filaments are entirely formed of PETP. The yarns 1 through 7 were made by applicant.

Table II gives the measuring results of a number of important properties of the yarns 1 to 7. They show that with the exception of incision these properties are at quite a good level for all yarns. For the monocomponent yarns 4 and 5 not made by the process of the invention, however, the incision factors are particularly unfavourable, viz. 1300 and 900 $\mu m^2$/hour, respectively.

For the bicomponent yarns 1, 2, 3, 6 and 7 made according to the invention the measured incision factors are 0, 113, 75, 0 and 0, respectively. This incision factor was measured by passing the yarns 1 to 7 over a bar of hardened silver steel for a period of 2 hours at a speed of 100 m/min and under a tension of 1 cN/dtex. The magnitude of the incision was subsequently determined by measuring the surface (in $\mu m2$) of the incision made by the yarn into the bar.

Moreover, cords were formed from all of the yarns 1 to 7. To that end each of the yarns was given a Z-twist of 500 turns per meter and subsequently three of these Z-twisted yarns were twisted together while giving them an S-twist of 250 turns/meter, resulting in a 3-ply fishing net cord. Of the cords thus formed a number of important properties were measured which are summarized in Table III. They show that the cords made from the bicomponent yarns according to the invention compare very favourably with the conventional black monocomponent yarns. The yarns 3 and 7 have a better knot strength.

The tenacity of the yarns and cords was determined in accordance with ASTM-D885M, the main differences in the procedure being the use of a CRE-tester, a length between clamps of 500 mm, a constant rate of specimen extension of 500 mm/min and Instron-4D clamps.

The linear density of the yarns was mainly determined in accordance with ASTM-D885M, 11.3 and 11.3.1, the test specimens having a length of only 5.0 m instead of 9.0 m.

The elongation at rupture of the yarn and the cord was measured in accordance with ASTM-D885M, the main differences in the test procedure being the use of a CRE-tester, a length between the clamps of 500 mm, a constant rate of specimen extension of 500 mm/min and Instron-4D clamps.

The loop-breaking strength was determined in accordance with ASTM-D2256 alternative C, the main differences in test procedure being the use of a CRE-tester, a length between clamps of 500 mm and a constant rate of specimen extension of 500 mm/min.

The dry and wet boiling shrinkage were determined in accordance with DIN53866.

The knot strength of the cord was determined in accordance with DIN 53842, page 2, 8.3, FIG. 1, use being made of a CRE-tester, a distance between clamps of 500 mm and a constant rate of specimen extension of 500 mm/min.

The cores of the above-described bicomponent filament yarns 1, 2, 3, 6 and 7 according to the invention contain black pigment. Likewise, it is possible to make bicomponent filament yarns according to the invention in which a reddish iron oxide pigment and/or white titanium dioxide pigment of the rutil type is (are) only present in the core, in which case the incision factor also is reduced with respect to that of a monocomponent filament yarn wherein the iron oxide pigment or said titanium dioxide pigment is present throughout the cross-section of the filaments and on the surface thereof. A further alternative according to the invention consists in making bicomponent filament yarns whose filament cores contain a blend of black pigment made up of carbon black particles and reddish pigment made up of iron oxide particles, so that a brownish coloured yarn is formed.

Use also may be made of pigment blends containing said titanium dioxide pigment. Within the scope of the invention various modifications may be made. Although hereinbefore the yarn according to the invention is often referred to as a bicomponent yarn, it should be stressed that also yarns are meant by it whose filaments contain more than two, for instance three or four, polymer components or whose filaments contain only one polymer component. Of this latter type, the yarns 6 and 7 in Table I are examples in that both the core and the sheath of the filaments are of PETP. According to the invention it is essential that the pigments containing said carbon black particles or iron oxides or titanium oxide particles of the rutil type should primarily be present only in the core, i.e. within a sheath or a peripheral zone, of the filaments and said pigments should not be present, or should be present only to a neglible extent, in a zone which is to be more or less regarded as the skin or periphery of the filaments.

Also conceivable in principle is an embodiment in which the amount of pigment gradually decreases from the center of the cross-sectional area of the filament towards the outer circumferential surface thereof, a practically negligible amount of said pigment being present in a thin skin or peripheral zone. Another embodiment of the yarn according to the invention may in principle consist in that none or substantially none of the pigments are contained in the core zone provided in the center of each filament or in the peripheral or circumferential skin zone thereof, the pigment only being present in an annular zone located between the central core zone and the skin. It should be added that the yarn according to the invention can be made in an effective manner by the bicomponent spinning system according to FIG. 1, which is known in itself from NL 6 512 920, and from GB 1 207 062 and GB 1 165 853. Although the yarns according to the invention are preferably formed from filaments having a circular cross-section, it is possible in principle also to use filaments having a different cross-section, for instance a polygonal or lobed cross-section. Also, the core of the filaments need not be round. Alternatively, use might be made of a nonround, for instance triangular, polygonal or lobed core.

U.S. Pat. Nos. 4,207,376, as well as 3,803,453, describe antistatic, multicomponent thrads. These patents describe a few embodiments wherein the core of the filaments contain a high percentage of carbon black for the purpose of rendering the yarn sufficiently conductive. In said publication it is mentioned that the filaments may advantageously be applied in antistatic carpets or in dark-coloured uniforms and like textile products. U.S. Pat. No. 4,085,182 also describes a process of manufacturing electrically conductive bicomponent filaments of the sheath-core type, the core containing a high percentage of carbon black for promoting electric conductivity.

We claim:

1. A synthetic filament yarn, comprising a plurality of filaments of a melt-spinnable polymeric material, each of said filaments having a core portion and a sheath portion surrounding the core portion so as to be concentric therewith, said core portion including at least one pigment selected from the group consisting of carbon black particles, iron oxide particles and titanium dioxide particles; said pigment being present in an amount of 0.2 to 2% by weight based upon the weight of the core portion; said sheath portion being characterized in that it is substantially pigment free; said yarn being characterized in that it has a total linear density in the range of Decitex 300 to 5000, a tenacity in the range of 50 to 85 cN/tex and an elongation at rupture of 7 to 15%.

2. The yarn of claim 1, wherein said plurality comprises 30–600 of said filaments.

3. The yarn of claim 1, wherein the sheath portion of the filaments comprises 15 to 50% of the filament cross-sectional area and the core portion comprises 50 to 85% of the filament cross-sectional area.

4. The yarn of claim 3, wherein the sheath portion comprises approximately 25% of the filament cross-sectional area and the core portion comprises approximately 75% of the filament cross-sectional area.

5. The yarn of claim 1, wherein the core portion includes carbon black particles in an amount of approximately 0.6% by weight based upon the weight of the core portion.

6. The yarn of claim 1, wherein the sheath portion of the filaments is transparent.

7. The yarn of claim 1, wherein the polymeric material comprises a polyester.

8. The yarn of claim 7, wherein the polyester is polyethylene terephthalate.

9. The yarn of claim 1, wherein the polymeric material of the sheath portion comprises a polyamide and the polymeric material of the core portion comprises a polyester.

10. The yarn of claim 9, wherein the polyester is polyethylene terephthalate.

11. The yarn of claim 1, further characterized in that the incision factor of the yarn is less than 250 $\mu m^2$/hour.

12. The yarn of claim 11, still further characterized in that the incision factor of the yarn is less than .50 $\mu m^2$/hour.

13. The yarn of claim 1, further characterized in that the yarn is made by a spin-drawing process.

14. An occupant restraint seat belt comprising the yarn of claim 1.

15. The seat belt of claim 14, wherein the sheath portion comprises 15 to 50% of the filament cross-sectional area and the core portion comprises 50 to 85% of the filament cross-sectional area.

16. The seat belt of claim 15, wherein the core portion includes carbon black particles in an amount of 0.6% by weight based upon the weight of the core portion.

17. The seat belt of claim 16, wherein the polymeric material comprises a polyester material.

18. The seat belt of claim 17, wherein the polyester material comprises polyethylene terephthalate.

19. A fishing net comprising the yarn of claim 1.

20. The fishing net of claim 19, wherein the sheath portion comprises 15 to 50% of the filament cross-sectional area and the core portion comprises 50 to 85% of the filament cross-sectional area.

21. The fishing net of claim 20, wherein the core portion includes carbon black particles in an amount of approximately 0.6% by weight based upon the weight of the core portion.

22. The fishing net of claim 21, wherein the polymeric material of the sheath portion comprises a polyamide material and the polymeric material of the core portion comprises a polyester material.

23. The fishing net of claim 22, wherein the polyamide material comprises nylon-6 and the polyester material comprises polyethylene terephthalate.

* * * * *